US006581995B1

(12) United States Patent
Zaayman

(10) Patent No.: US 6,581,995 B1
(45) Date of Patent: Jun. 24, 2003

(54) HOIST ARRANGEMENT FOR A DRAGLINE RIGGING

(75) Inventor: Oswald Cornelius Dannhauser Zaayman, Pretoria (ZA)

(73) Assignee: Caterpillar Commercial Sarl, Geneva (CH)

( * ) Notice: Subject to any disclaimer, the term of this patent is extended or adjusted under 35 U.S.C. 154(b) by 0 days.

(21) Appl. No.: 09/582,013

(22) PCT Filed: Feb. 2, 2000

(86) PCT No.: PCT/IB00/00101

§ 371 (c)(1),
(2), (4) Date: Nov. 14, 2000

(87) PCT Pub. No.: WO00/77309

PCT Pub. Date: Dec. 21, 2000

(30) Foreign Application Priority Data

Jun. 14, 1999 (ZA) ..... 99/3943

(51) Int. Cl.[7] ..... B66C 1/12; E02F 3/00
(52) U.S. Cl. ..... 294/81.5; 294/68.3; 37/399
(58) Field of Search ..... 294/67.1, 67.4, 294/68.26, 68.27, 68.3, 74, 81.2, 81.21, 81.5, 81.51, 81.55, 81.56, 81.1; 37/395, 397–399

(56) References Cited

U.S. PATENT DOCUMENTS 1,152,342 A * 8/1915 Perkins ..... 294/68.27
1,541,090 A * 6/1925 Yunkes ..... 294/81.5
2,452,243 A * 10/1948 Johnson ..... 294/68.27
3,018,128 A * 1/1962 Nelson et al. ..... 294/74
3,425,737 A * 2/1969 Sutton ..... 294/74
3,512,664 A * 5/1970 Tolle ..... 294/74 X
4,209,044 A * 6/1980 Taki ..... 294/74 X
4,295,677 A * 10/1981 Petrin ..... 294/68.26
4,354,704 A * 10/1982 Mayerjak ..... 294/74
5,343,641 A 9/1994 Gregory
5,367,798 A 11/1994 Hughes
5,863,085 A 1/1999 Khachaturian
5,975,603 A * 11/1999 Novak-Taurman et al. 294/81.5 X

FOREIGN PATENT DOCUMENTS

FR 2272946 A 12/1975

* cited by examiner

*Primary Examiner*—Dean J. Kramer
(74) *Attorney, Agent, or Firm*—Kilpatrick Stockton LLP

(57) ABSTRACT

The invention relates to a hoist arrangement (10) for a dragline rigging. The hoist arrangement includes a triangular framework comprising a hollow fibreglass spreader bar (14) and two fibreglass ties (12) which are attachable to the spreader bar. The fibreglass ties (12) are connectable to a pick-up link on a dragline rigging, and a pair of lower hoist members in the form of wire-reinforced, synthetic rubber belts (16) depend from the spreader bar (14) and include attachment formations (42) at lower ends thereof for attaching the hoist arrangement (10) to trunnions on a dragline bucket.

7 Claims, 4 Drawing Sheets

HOIST ARRANGEMENT FOR A DRAGLINE RIGGING

BACKGROUND OF THE INVENTION

This invention relates to a hoist arrangement for a dragline rigging.

Conventional dragline riggings include a hoist arrangement which is connectable to a dragline bucket for hoisting the bucket during excavation. The known hoist arrangements generally comprise a pair of lower hoist chains which are connectable to trunnions on the side walls of the bucket, a spreader bar above the bucket to hold the lower hoist chains away from the bucket side walls during hoisting so as to prevent these chains from damaging the side walls, and a pair of upper hoist chains connected at lower ends to the spreader bar and at upper ends to a pick-up link on the dragline rigging. Typically, the lower and upper hoist chains are formed from an abrasive-resistant steel and are oversized to account for wear during operation. The spreader bar is also formed from steel and together with the lower and tipper hoist chains tends to be relatively heavy.

Although conventional hoist arrangements are durable, the total mass which the dragline boom has to carry when the dragline bucket is hoisted includes the mass of the hoist arrangement, and it is therefore desirable to have a hoist arrangement with a relatively low mass so that the loading capacity of the dragline bucket itself, and hence the efficiency of the dragline, can be increased.

SUMMARY OF THE INVENTION

According to the invention there is provided a hoist arrangement for a dragline rigging comprising:

a pair of lower hoist members which are attachable to trunnions on a dragline bucket; and an upper hoist member in the form of a triangular framework formed at least predominantly from fibreglass, the triangular framework including first attachment formations for attachment to the lower hoist members so as to hold these members apart from one another and at least one second attachment formation for attachment to a pick-up link on the dragline rigging.

In a preferred embodiment of the invention, the upper hoist member includes a hollow fibreglass spreader bar and two fibreglass ties which are attachable to the spreader bar.

The spreader bar may include steel inserts which are arranged to receive replaceable bushes or sealed bearing units for attaching the spreader bar to the fibreglass ties and to the lower hoist members. Similarly, the fibreglass ties may include steel inserts which are designed to carry replaceable bushes or sealed bearing units for attaching the ties to the spreader bar and to the pick-up link.

In another embodiment, the spreader bar is secured to the fibreglass ties with bolts and the triangular framework includes a series of swivel bearings for attaching the framework to the lower hoist members and to the pick-up link.

The lower hoist members may comprise at least two wire-reinforced, synthetic rubber belts, and may include an abrasive-resistant cover.

Typically, the hoist belts are attached to steel connectors for connecting the belts to the spreader bar and to the trunnions on the dragline bucket.

In another arrangement, the lower hoist members comprise two endless slings each of which includes a portion which is cast into a polyurethane connector for connecting the sling to one of the trunnions on the dragline bucket.

BRIEF DESCRIPTION OF THE DRAWINGS

The invention will now be described in more detail, by way of example only, with reference to the accompanying drawings in which.

DESCRIPTION OF THE PREFERRED EMBODIMENTS

Figures 1, 2, 3:
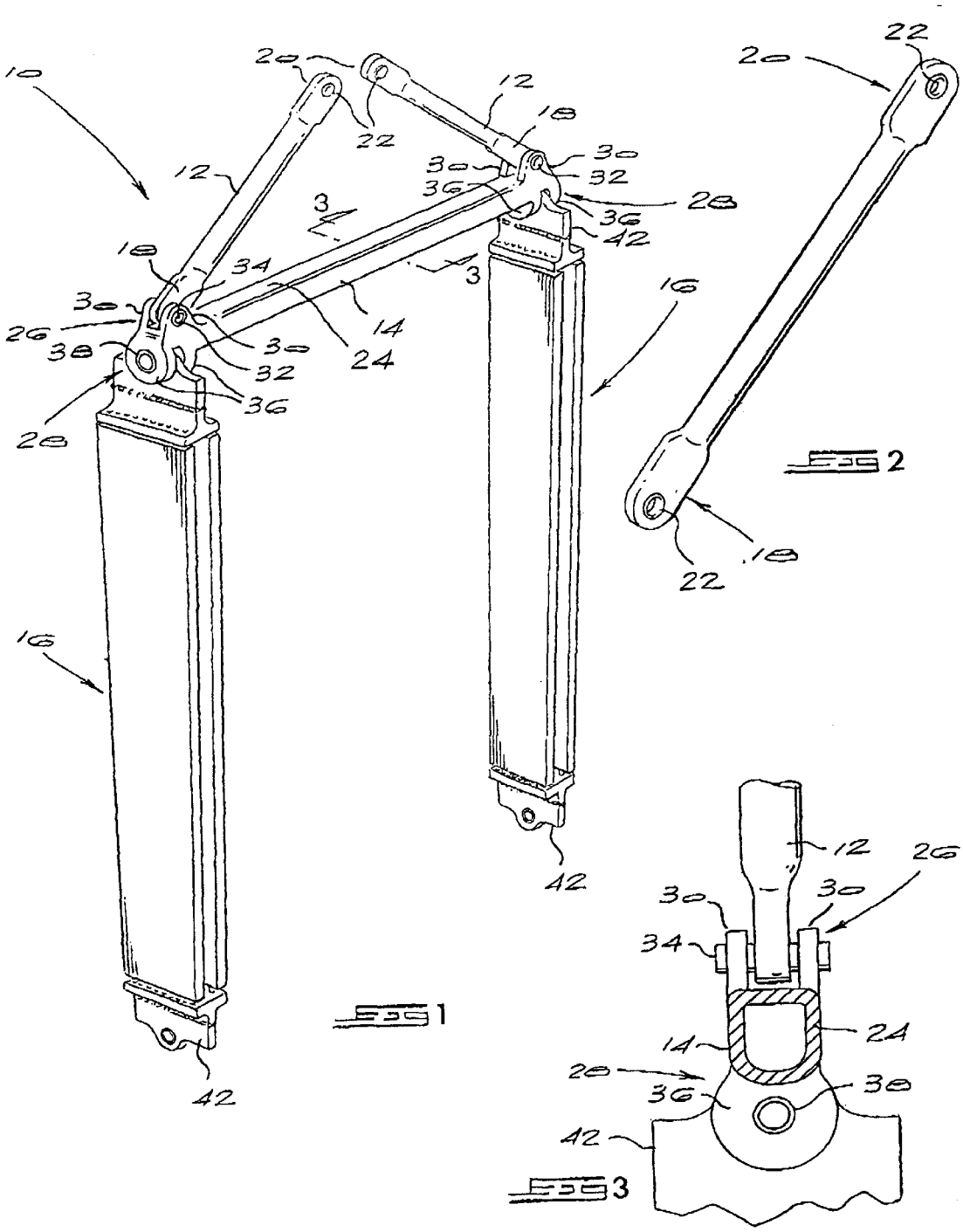
FIG. 1 shows a perspective view of a hoist arrangement according to the present invention.
FIG. 2 shows a perspective view of a fibreglass tie forming part of the hoist arrangement illustrated in FIG. 1.
FIG. 3 shows a cross-sectional view along the line 3—3 in FIG. 1.

A hoist arrangement forming part of a dragline rigging is illustrated in FIG. 1 of the drawings. The hoist arrangement is designated generally with the reference numeral 10 and includes a pair of upper hoist ties 12, a strut in the form of a spreader bar 14, and a plurality of lower hoist belts 16 depending from the spreader bar.

The ties 12 are formed from fibreglass and include attachment formations at each end 18 and 20 thereof The attachment formations are in the form of steel inserts (not visible) which are arranged to carry replaceable bushes 22, as shown most clearly in FIG. 2. The bushes 22 allow the ties to be detachably connected to the spreader bar and to a pick-up link (not shown) on the dragline rigging so as to form a triangular framework.

The spreader bar 14 is also formed from fibreglass and includes a central hollow region 24 (see FIGS. 1 and 3), and upper and lower attachment formations 26 and 28, as shown. Each formation 26 comprises two limbs 30 which define an opening for receiving an attachment formation on one of the ties 12. The limbs 30 carry steel inserts (not visible) into which are fitted replaceable bushes 32. In practice,,each tie 12 is connected to the spreader bar 14 by inserting the attachment formation 18 on the tie into the opening defined by one of the formations 26 so that the bushes 32 on the spreader bar are aligned with the bush 22 on the tie; and passing a locking pin 34 through the respective bushes to lock the two components together. The ties 12 are connectable to the pick-up link on the dragline rigging in a similar fashion to that described above so that they can be disconnected from the pick-up link and the spreader bar for repair or replacement, if necessary.

In FIG. 1, each lower attachment formation 28 on the spreader bar 14 is seen to include a pair of spaced-apart limbs 36 which define a connection opening in the gap between these limbs. Similarly to the limbs 30, the limbs 36 carry steel inserts (not visible) and bushes 38 for attaching the spreader bar to the hoist belts 16. The attachment formations 26 and 28 in this embodiment are arranged orthogonally with respect to one another, as illustrated. Also, the spreader bar in this embodiment is shaped so as to include a rounded bottom end (see FIG. 3) which facilitates the distribution of loads when this bar is subjected to impacts during use.

Figures 4, 5A, 5B:
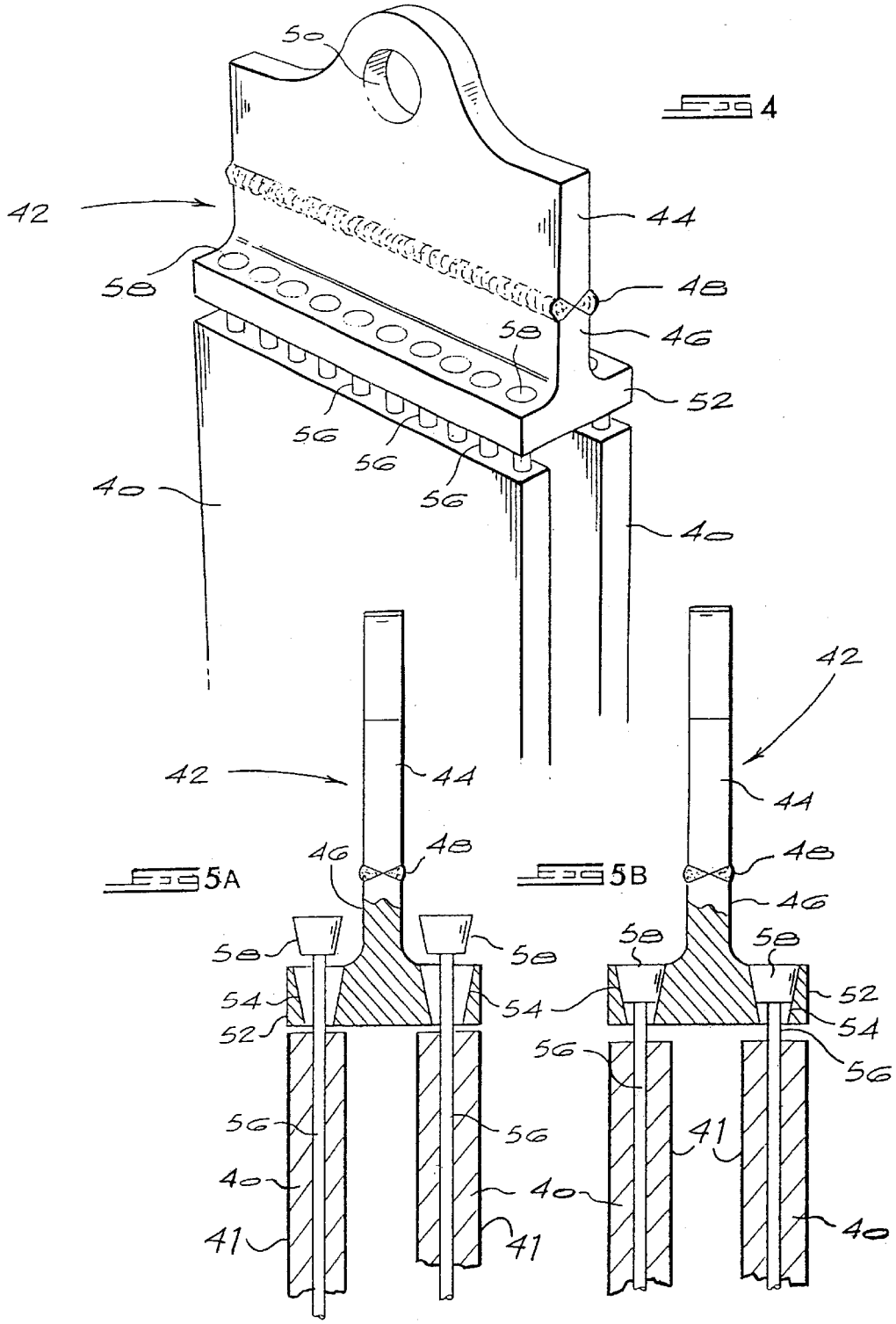
FIG. 4 shows a perspective view of an upper portion of a belt and connector forming part of the hoist Arrangement illustrated in FIG. 1.
FIGS. 5A and 5B show cross-sectional views of the belt and connector of FIG. 4 at successive stages during the attachment of the belt to the connector.

With particular reference now to FIGS. 4 to 5B of the accompanying drawings, each lower hoist member of the hoist arrangement 10 is formed by a pair of side-by-side belts 40. These belts are formed from a wire-reinforced, synthetic rubber typically used for conveyor belts and have an abrasive-resistant cover 41 such as a Class A cover manufactured by Dunlop. The belts 40 are connected at each end to steel connectors 42 in the manner illustrated in FIGS. 5A and 5B.

The connectors 42 comprise two high strength steel plates 44 and 46 which are welded to one another with butt welds 48, as shown. The upper steel plate 44 defines an aperture 50 into which is fitted a bush (not illustrated). Each connector 42 is connected to the spreader bar 14 by feeding the plate 44 into the connection opening between the limbs 36 so that the bushes 38 on the spreader bar are aligned with the bush on the plate 44 and passing a locking pin through the bushes to lock the connector to the spreader bar.

The lower plate 46 has a flange 52 defining a series of tapered bores 54 which are sized to receive reinforcing wires 56 in the belts 40. The belts are connected to the flanges 52 by threading the wires 56 through the bores 54 from below and then casting a farrell 58 onto each wire in the manner illustrated in FIG. 5A. The cast farrells are designed to be seated within the tapered bores 54 (see FIG. 5B) so as to prevent the wires 56 from being withdrawn from the flanges 52.

The connectors 42 at the lower ends of the belts 40 are connected to the belts in a similar manner to that described above and are attachable to trunnion pins (not illustrated) on dragline bucket trunnions (also not illustrated) so as to connect the hoist arrangement 10 to a dragline bucket.

Figure 7:
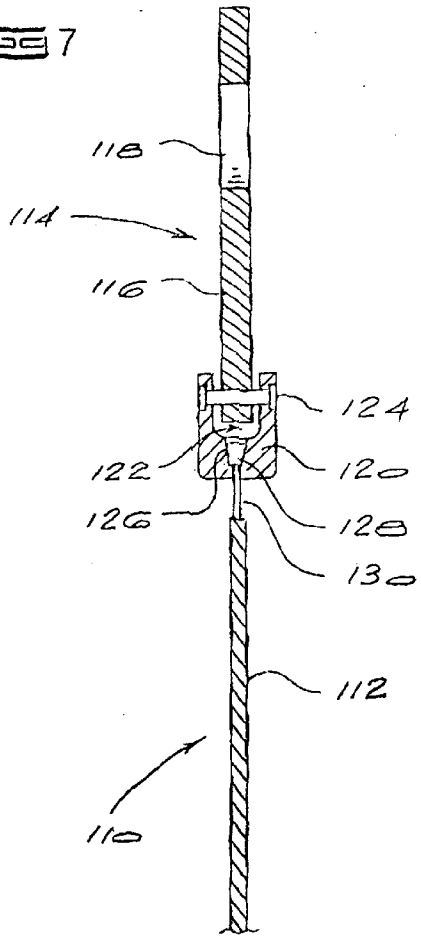
FIG. 7 shows a cross-sectional view along the line 7—7 in FIG 6.
Figure 6:
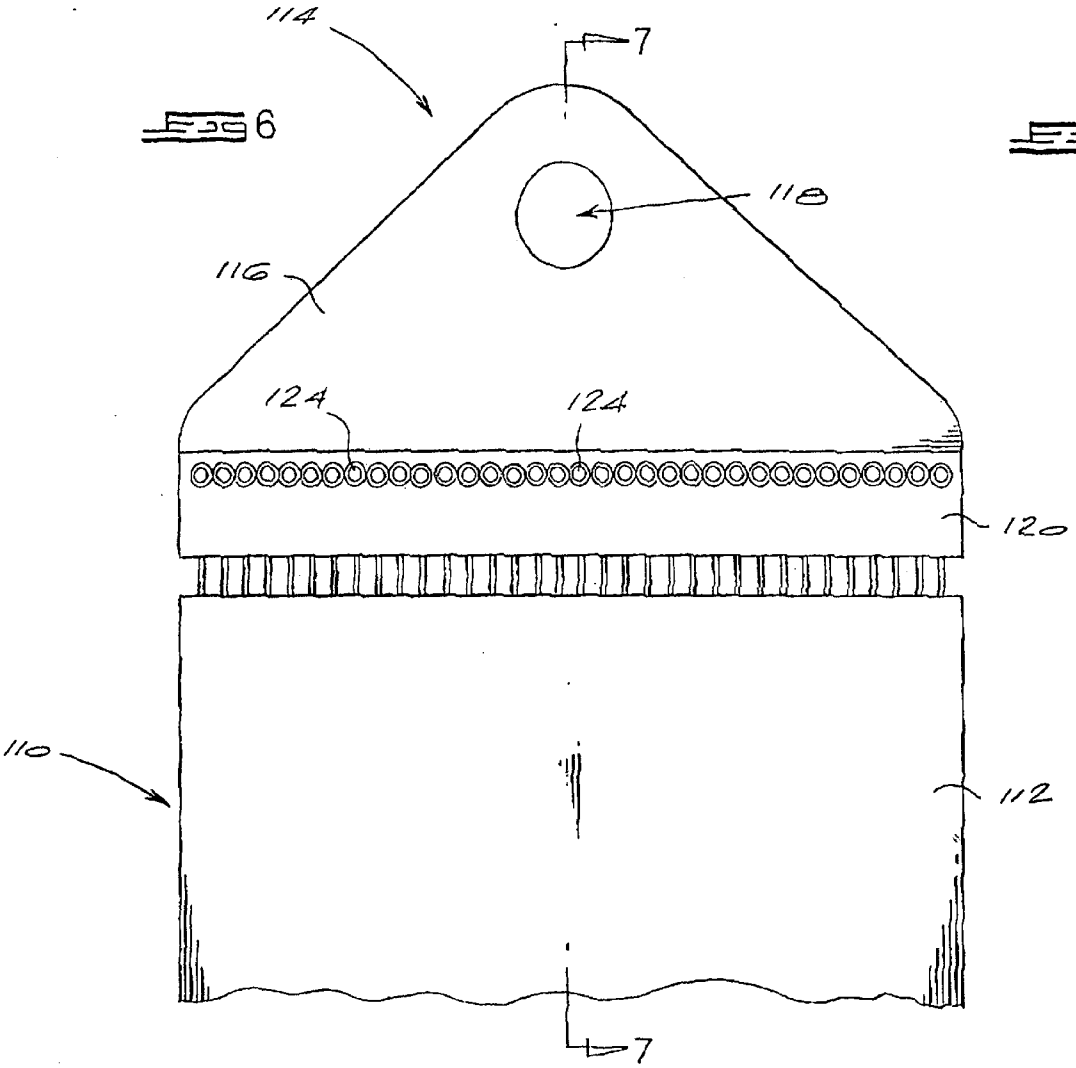
FIG. 6 shows a side view of an upper portion of a belt and connector according to another embodiment of the invention.

FIGS. 6 and 7 illustrate a portion of a lower hoist member 110 according to another embodiment of the invention. In this case, each lower hoist member comprises a single synthetic rubber belt 112 and a connector 114 at each end of the belt. Similarly to the belts 40 of the first embodiment, the belt 112 is formed from a wire-reinforced, synthetic rubber and includes an abrasive resistant cover.

The connectors 114 each include a plate 116 which defines an aperture 118 for attaching the belt to a trunnion pin on a dragline bucket and to the spreader bar 14. An elongate link 120 including a longitudinal slot 122 is arranged to fit over one end of the plate 116, as shown, and to be connected to the plate with a series of bolts 124 typically Allen bolts. The link 120 also includes a number of tapered bores 126 which are designed to receive farrells. 128 cast onto wires 130 in the belt 112.

Figure 8:
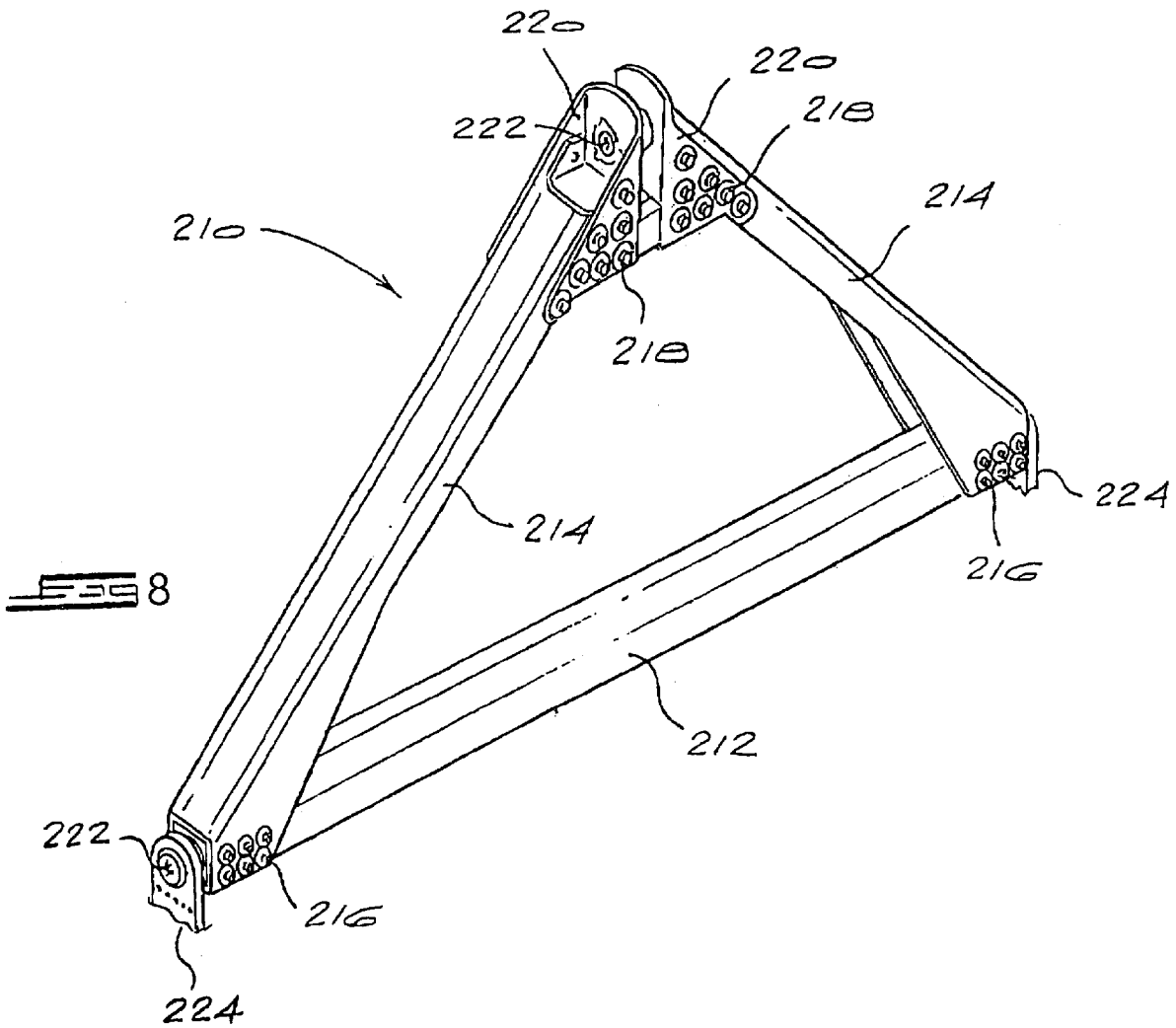
FIG. 8 shows a perspective view of an upper portion of a hoist arrangement according to another embodiment of the invention.

In practice, the wires 130 are fed through the bores 126, the farrells are cast onto the wires so as to connect the belt 112 to the link 120, and the plate 116 is then connected to the link with the bolts 124, Another embodiment of the triangular framework for the hoist arrangement of the invention is illustrated in FIG. 8. In this Figure, the framework 210 is seen to include a hollow, fibreglass spreader bar 212 and a pair of channel-shaped, fibreglass ties 214 connected to the spreader bar with bolts 216. The upper ends of the fibreglass ties 214 are connected with bolts 218 to fibreglass brackets 220 which are designed to connect the framework 210 to a pick-up link (not shown). Swivel bearings 222 allow for a degree of lateral movement between the pick-up link and the ties 214, and between the ties and the lower hoist members (not shown).

In this embodiment, the lower hoist members comprise slings (not illustrated) that are cast into polyurethane connectors (also not illustrated) at lower ends thereof for connecting the slings to trunnion pins on a dragline bucket. The upper ends of the slings are connectable to connectors 224 (which are only partially illustrated in FIG. 8) with shackles (not shown).

It should be appreciated that the hoist arrangement according to the embodiments of the invention described above is relatively lightweight when compared with conventional steel hoist arrangements. This is mainly due to the fact that the upper hoist ties and the spreader bar are formed predominantly from fibreglass and the lower hoist members comprise synthetic rubber belts or slings. Also, the components of the hoist arrangement are all connectable to one another so that they can be removed for repair or replacement relatively easily.

What is claimed is:

1. A hoist arrangement for a dragline rigging comprising:

a pair of lower hoist members which are attachable to trunnions on a dragline bucket, each lower hoist member including a wire-reinforced, synthetic rubber belt; and an upper hoist member in the form of a triangular framework which includes first attachment formations for attachment to the lower hoist members so as to hold these members apart from one another and at least one second attachment formation for attachment to a pick-up link dragline rigging.

2. A hoist arrangement according to claim 1, wherein the upper hoist member includes a hollow fibreglass spreader bar and two fibreglass ties which are attachable to the spreader bar.

3. A hoist arrangement according to claim 2, wherein the spreader bar includes an upper attachment formation at each end thereof for attaching the spreader bar to the fiberglass ties and a lower attachment formation at each end thereof for attaching the spreader bar to the lower hoist members.

4. A hoist arrangement according to claim 3, wherein each fiberglass tie includes a first attachment formation at one end thereof for attaching the tie to the spreader bar and a second attachment formation at the opposite end thereof for attaching the tie to the pick-up link.

5. A hoist arrangement according to claim 1, wherein the wire-reinforced synthetic rubber belts include an abrasive-resistant cover.

6. A hoist arrangement according to claim 1, including steel connectors for connecting the belts to the spreader bar and to trunnions on the dragline bucket.

7. A hoist arrangement according to claim 1, wherein the two wire-reinforced, synthetic rubber belts are connected side by side to each end of the spreader bar and each trunnion on the dragline bucket.

* * * * *